United States Patent [19]

Marencak

[11] 4,155,816

[45] May 22, 1979

[54] METHOD OF ELECTROPLATING AND TREATING ELECTROPLATED FERROUS BASED WIRE

[75] Inventor: Karol Marencak, Bissen, Luxembourg

[73] Assignee: The Goodyear Tire & Rubber Company, Akron, Ohio

[21] Appl. No.: 947,234

[22] Filed: Sep. 29, 1978

[51] Int. Cl.[2] ..... C25D 7/06; C25F 5/00

[52] U.S. Cl. ..... 204/28; 204/146; 204/231

[58] Field of Search ..... 204/146, 28, 231, DIG. 7

[56] References Cited

U.S. PATENT DOCUMENTS

| | | | |
|---|---|---|---|
| 2,424,173 | 7/1947 | Huston et al. | 204/28 |
| 2,686,859 | 8/1954 | Gray et al. | 204/28 |
| 2,725,352 | 11/1955 | Strobel | 204/28 |
| 3,178,305 | 4/1965 | Ward | 204/146 |
| 3,394,063 | 7/1968 | Blume | 204/146 |
| 3,471,338 | 10/1969 | Trachtenberg | 204/129.65 |
| 3,959,099 | 5/1976 | Froman et al. | 204/231 |
| 3,988,216 | 10/1976 | Austin et al. | 204/DIG. 7 |

*Primary Examiner*—T. M. Tufariello

*Attorney, Agent, or Firm*—H. C. Young, Jr.

[57] ABSTRACT

Method of treating ferrous based wire comprised of (A) electroplating a negatively charged ferrous based wire in a prescribed aqueous electrolyte solution containing a positively charged stationary anode and, in combination, simultaneously, in the same electrolyte solution, (B) deplating a similarly electroplated ferrous based wire by passing said plated wire as a supplemental, additional, positively charged, moving anode through said solution to effect a removal of its electroplated outer metal coating.

1 Claim, 1 Drawing Figure

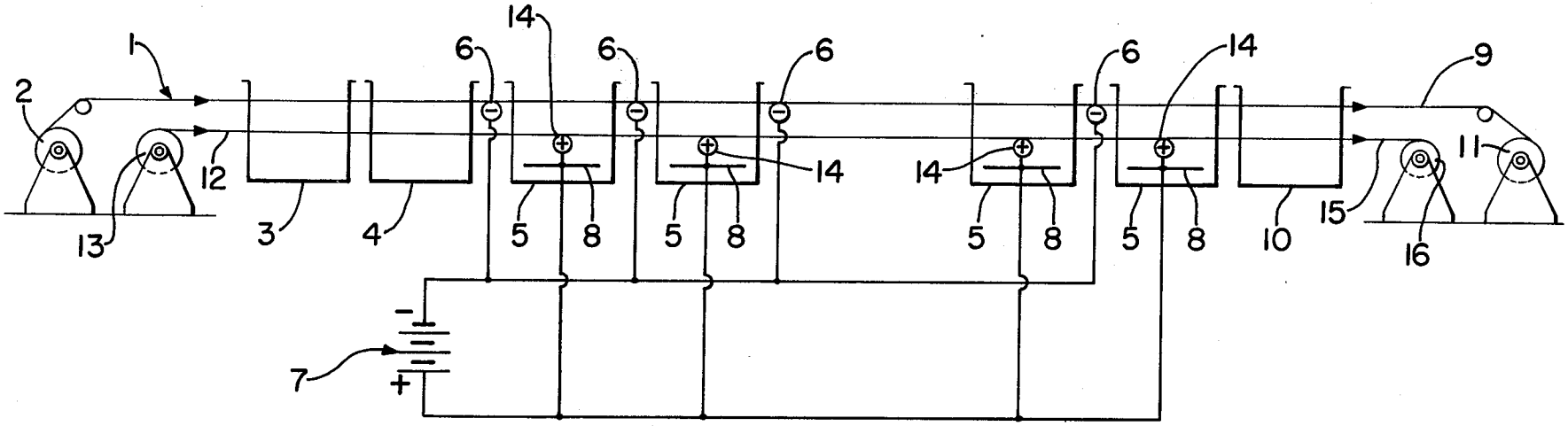
1
2
3
4
5
6
7
8
9
10
11
12
13
14
15
16
+
-

METHOD OF ELECTROPLATING AND TREATING ELECTROPLATED FERROUS BASED WIRE

This invention relates to a combination of electroplating and treating electroplated ferrous based wire. The invention particularly relates to a method of electrolytically demetalizing electroplated steel wire.

BACKGROUND ART

Steel wires have heretofore been coated with various metals such as zinc, copper, tin and/or their alloy such as brass or bronze, in order to enhance their adhesion to rubber.

Typically, such coatings have been applied to the steel wire either electrolytically by electroplating in a suitable solution or by dipping or drawing through a molten metal. Generally, the electroplating method is preferred.

In a conventional electroplating process, the wire becomes the cathode, when charged with a negative polarity, as it is drawn through an aqueous solution, or electrolyte, in which is also immersed a metal anode, which is charged with a positive polarity. The electrolyte contains dissolved oppositely charged ions. As the negative polarity is applied to the wire cathode and a corresponding positive polarity applied to the anode, the cations move toward the cathode and the anions move toward the anode. Indeed, as the current passes between the cathode and the anode, the positive ions are attracted toward the negatively charged anode where their charge is neutralized and they are set free, leaving them deposited or plated, on the wire cathode. Similarly, the anions move to, and are discharged at, the anode.

Generally, the electrolyte is modified by containing a salt of the metal anode, thereby enhancing the deposition of the metal onto the wire cathode.

Indeed, the electrolyte, or aqueous plating bath, may consist of a number of optional components which may include (a) the said salt containing the metal ion, (b) an additional salt for the function of modifying the conductivity of the bath, (c) a compound to modify the anode corrosion and reduce its passivity, (d) an addition agent to effect the type of deposit produced and (e) a buffer to maintain or control the desired pH.

All of these materials, as well as their temperature and length of time of exposure to the wire cathode, have an effect on the rate of current consumed by the cathode and anode and, of particular importance, have an effect on the thickness and structure of metal deposition on the cathode wire. They may even effect the elasticity of the resultant plated wire composite.

All of these factors typically become of special importance when preparing a coated steel wire which has adhesion to rubber as its intended use.

Therefore, if an imbalance occurs between either the materials, the temperature, electrical current being applied, or even the time of exposure of the wire to the electrolyte, an off-specification coated wire can occur. Such off-specification can relate to coating thickness, the structure of the coating, the elasticity of the coating-/wire composite, defective base wire itself, as well as actual portions of the wire which may have defective or no coating at all.

Unless an involved and generally prohibitively expensive recovery process is utilized, the off-specific tion wire has heretofore been usually scrapped.

In virtually any commercial electroplating process, disposal of off-specification electroplated products can be a problem. Recovery of the base metal has been reported by (a) chemical oxidation of the plated metal with acid to form a soluble salt, (b) electrolytic oxidation by reversing current flow in a conventional electroplating bath and (c) oxidation of the plated metal with a strong oxidizing agent (U.S. Pat. No. 2,937,940).

Chemical oxidative demetalizing is generally objectionable because of cost and necessity of additional equipment, chemicals and effluent treatment.

Electrolytic demetalization of brass electroplated steel wire, utilizing a reversal of current flow could be generally objectionable (a) in solutions containing cyanide because of the necessity of effluent treatment and (b) in solutions under acid conditions, the base steel wire would be degraded by pitting and the like. The problem is that most acidic electroplating baths would also attack the base material if it were positively charged.

Therefore, it is an object of this invention to provide a method of relatively efficiently recovering or deplating wire which has been electroplated.

DISCLOSURE AND PRACTICE OF THE INVENTION

In accordance with this invention, a method of treating a ferrous based wire comprises (A) electroplating an outer metal coating onto a ferrous based wire by continuously passing said wire, as a negatively charged cathode, through at least one aqueous electrolyte solution having a basic pH in the range of about 9 to about 14, preferably about 10 to about 13, containing a positively charged, stationary, anode immersed therein, preferably of the electroplating metal, and containing a water soluble salt of the electroplating metal, to effect the plating of said metal onto said ferrous based wire as an outer layer and in combination, simultaneously, and in the same electrolyte solution, (B) deplating a similarly electroplated ferrous based wire by continuously passing said plated wire as a supplemental, additional, positively charged, traveling anode, through said electrolyte solution to effect a removal of said electroplated outer metal coating from the base metal wire.

In the practice of this invention, the aqueous electrolyte solution, or plating bath, is adjusted to a temperature of about 35° C. to about 65° C., preferably about 50° C. to about 55° C. A cathodic current density, from the applied negative voltage to the wire being plated, is used in the range of about 5 to about 30, preferably about 12 to about 15 ampheres per square decimeter ($dm^2$) of wire surface area. Rate of travel of the wire being electroplated through the electrolyte solution is adjusted to provide a desired coating thickness, such as an overall exposure time in the solution of about 5 to about 60 seconds or more.

In the instance of where it is desired to apply a brass coating to steel wire, the electrolyte typically contains both copper and zinc salts having a copper to zinc mole ratio in the range of about ½ to about 2/1. Various salts of copper and/or zinc can be used such as cyanide or other complex building anions.

Further, it is generally desired to provide an additional salt for the function of enhancing the conductivity and other electrochemical conditions of the bath.

Representative of such salts are sodium or potassium carbonate.

It is generally desired that the concentration of the metal plating salts in the electrolyte solution is in the range of about 15 to about 150 grams per liter of the metal. For example, in the brass electroplating of steel wire, a concentration of copper and zinc salts sufficient to produce an electrolyte solution containing about 10 to about 50 grams per liter of copper can be used. The basic pH of the solution can be adjusted to its desired range by the addition of a base such as sodium hydroxide, potassium hydroxide or sodium bicarbonate.

In the practice of this invention it should be appreciated that in the basic electroplating process, conditions are optimized to favor obtaining the proper thickness and surface structure of the electroplated coating onto the wire. In these regards, then, the speed or rate of passing the wire cathode to the electrolytic bath is balanced according to the metal being plated thereon, conductivity of the bath and electrical current being applied.

Therefore, it is to be further appreciated that, in the same electrolytic bath, the plated wire supplemental anode (with its positive charge) is usually fed at a different speed or rate than its cathode wire counterpart depending upon the nature of its defect. Indeed, since the electrolytic bath conditions are not intended to be necessarily optimized for deplating or debrassing steel wire, it is anticipated that the plated wire will be usually fed at a slower rate through the same electrolytic bath.

Although the brass electroplating of steel wire and concurrent, simultaneous, coexistant, supplemental anode deplating is exemplified, it is intended that the concept be extended to combined electroplating and de-electroplating of base metals generally. The concept is, however, more narrowly directed to electroplating operations involving electroplating solutions which will not detrimentally degrade the base metal itself as a supplemental, positively anode immersed in the same electrolytic solution as its cathodic, negatively charged, base wire counterpart. Usually, it is desired that the base metal is a ferrous-based metal representative of which is steel. Representative of various electroplating metals are, for example, copper, zinc, tin, cadmium, silver, nickel, chrome and their alloys such as, for example, brass and bronze.

In the description of this invention, it should be pointed out that a process of making rubber reinforcing wire typically begins with a raw material of steel wire, normally, 5 to 5.5 millimeters in diameter, which is (A) drawn through dies to a substantially smaller diameter by variations of the steps of (1) pickling and/or cleaning, (2) water rinse, (3) patenting, which may include austenitization followed by isothermal cooling, and (4) drawing the wire through successive dies until the diameter is decreased generally to between 0.75 and 1.4 millimeters; (B) electroplated by passing the wire through an aqueous electrolytic metal coating bath to electroplate the metal or alloy coating onto the wire, followed by water rinsing and drying; (C) drawn as electroplated wire until the diameter is decreased generally to between 0.08 and 0.4 millimeters; and (D) twisted as electroplated wire filaments into strands and cabling the twisted strands together.

Variations of this process are, of course, possible. For example, the brass coating of steel wire can be achieved by depositing brass alloy or alternate successive layers of copper and zinc onto the steel wire which can produce brass by migration or mixing between the copper and zinc as taught by U.S. Pat. No. 2,002,261. Heat treatment can be applied to produce a similar result.

Corrosion protection can be added by coating the steel wire before the brass plating step with nickel or nickel alloy as taught by U.S. Pat. No. 3,749,558. An initial coat of zinc metal prior to brass plating (U.S. Pat. No. 2,870,526) may be used for the same purpose.

A lubricant is generally used in the drawing step to dissipate heat generated in drawing the wire and to lubricate the wire. It can be applied in a number of ways such as spraying or by a bath surrounding both the die and the wire in the vicinity of the die.

For a better understanding of the invention, reference is made to the drawing which depicts a brass electroplating process for treating steel wire and, in the same electrolyte bath and concurrently, the process for debrassing said electroplated wire.

Inspection of the drawing shows bright steel wire 1, which has been patented, being continuously fed from a let-off roll 2, through a cleaning bath 3 of a six percent aqueous rinse bath 4. From the rinse bath 4, the steel wire is fed through at least one electrolyte bath 5, by passing over a contact 6, to which is applied a negative charge from a rectifier 7 thereby causing the steel wire itself to become a cathode in the electroplate baths 5. The electrolyte baths are adjusted to a temperature of about 55° C. and a pH of about 12 and each individually contains an immersed static brass anode 8 to which is applied a positive charge from the rectifier 7.

The aqueous electroplating baths 5 are comprised of water, copper and zinc water soluble salts in a concentration of about 40 grams copper per liter with a copper/zinc mole ratio of about 3/2 and solution modifying compounds.

From the electroplating bath 5, the electroplated wire 9 is rinsed in an aqueous bath 10, recovered and wound on a wind-up roll 11.

Off-specification brass electroplated wire 12, particularly such plated wire treated by the process shown in this drawing, which would otherwise be scrapped, is continuously fed from let-off roll 13 over a contact 14 into the same electroplating baths 5, simultaneously with the electroplating of the steel wire 1. However, to contact 14 is applied a positive charge from the rectifier 7, thereby causing the traveling electroplated wire 12 to become a mobile supplemental anode for the effective electroplating of the moving steel wire 1.

The deplated wire 15 is then recovered on wind-up roll 16.

Although the drawing shows the stationary anode 8 and wire traveling anode 12 connected together with the same potential, this invention offers other valuable alternatives. For example, the stationary anode 8 and traveling anode 12 could be disconnected with the positive voltage applied to the stationary anode 8 being higher or lower than the voltage applied to the wire 12. Thus, the combination of stationary and traveling anodes could contribute in a controlled but disproportionate degree to the electroplating of the traveling wire cathode thereby optionally favorably enhancing either or both the plating of the wire cathode or deplating of the wire anode.

The practice of this invention is further illustrated by reference to the following examples which are intended to be representative rather than restrictive of the scope of the invention. Unless otherwise indicated, all parts and percentages are by weight.

EXAMPLE 1

Steel wire was coated with brass, on a continuous basis by the following method:

An electrolytic solution comprised of water, zinc cyanide, copper cyanide in an amount of 40 grams copper per liter and a copper to zinc mole ratio of about 1.2/1, and solution modifiers, was charged to a series of troughs to form a series of baths. The solution was adjusted to a temperature of about 55° C. and pH of about 12. A positively charged static anode was positioned in the bottom of each of the baths in the form of a brass plate.

A multiplicity of bright, patented steel wires were continuously fed in parallel from spools through aqueous six percent sulfuric cleaning and aqueous rinsing baths and through the electrolytic solution baths in the troughs in a manner shown in the drawing of this specification. The wire was then passed through an aqueous bath, dried and wound on a spool.

A negative voltage of about five volts was applied to each of the moving steel wires through a pulley as cathodes, resulting in a cathodic current density of about 15 amperes (amps) per square decimeter of wire surface in the electrolytic baths.

The resultant electroplated steel wire had a brass coating thereon of about 5 grams of brass per kilogram of wire (g/kg).

A portion of the brass electroplated wire was found to be defective by having too thick of a brass coating of about 8 g/kg. Also, such electroplated wire has been found to be defective by having an improper ratio of copper to zinc.

The steel base metal wire was recovered from the defective brass coated wire by running the plated wire as a supplemental positively charged anode through the same electrolytic bath simultaneously, or at the same time, as the steel cathode wire is being plated in the bath in the manner shown in the drawing of this specification.

As a result, the recovered, deplated, steel wire was sufficiently clean that it did not have to be recleaned by special acid cleaning steps and, therefore, could be fed right back through the electrolytic solution baths.

While certain representative embodiments and details have been shown for the purpose of illustrating the invention, it will be apparent to those skilled in this art that various changes and modifications may be made therein without departing from the spirit or scope of the invention.

What is claimed is:

1. A method of treating a ferrous based wire which comprises (A) electroplating an outer metal coating onto a ferrous based wire by continuously passing said wire, as a negatively charged cathode, through at least one aqueous electrolyte solution having a basic pH in the range of about 9 to about 14, containing a positively charged, stationary anode immersed therein and containing a water soluble salt of the electroplating metal, to effect the plating of said metal onto said ferrous based wire as an outer layer and in combination, simultaneously, and in the same electrolyte solution, (B) deplating a similarly electroplated ferrous based wire by continuously passing said plated wire as a supplemental, additional, positively charged anode, through said electrolyte solution to effect a removal of said electroplated outer metal coating from the base metal wire.

2. The method of claim 1 where the aqueous electrolyte solution has a temperature in the range of about 35° C. to about 65° C., where said positively charged, stationary, immersed anode is comprised of the electroplating metal and where a cathodic current density, from the applied negative voltage to the wire being plated, is in the range of about 5 to about 30 amperes per square decimeter of immersed wire surface area.

3. The method of claim 2 as a method of treating a ferrous based wire where said immersed stationary anode is a metal selected from at least one of copper, zinc, tin, cadmium, silver, nickel, chrome or their alloy, and and where said electrolyte solution contains at least one corresponding water soluble salt of said metal.

4. The method of claim 2 as a method of treating steel wire where said anode is optionally comprised of at least one of copper, zinc, tin, nickel or their alloy and where said electrolyte solution contains at least one water soluble salt of copper, zinc, tin, nickel or mixture of said salts, in an amount of about 15 to about 150 grams per liter of said metal, and said salts corresponding to said metal or alloy of said anode if its is comprised thereof.

5. The method of claim 3 where said ferrous based wire is a steel wire having a diameter in the range of about 0.75 to about 1.4 millimeters.

6. The method of claim 3 or 4 as a method of treating steel wire which comprises (A) brass electroplating a traveling negatively charged steel wire in said aqueous electrolyte solution containing water soluble copper and zinc salts in a copper/zinc mole ratio in the range of about 2/1 to about 1/1 in an amount of about 10 to about 50 grams of copper per liter, said solution having a stationary, positively charged anode immersed therein comprised of brass and (B) simultaneously and in the same solution debrassing a similarly brass electroplated steel wire as a supplemental, positively charged traveling anode.

7. The method of claims 1 or 3 where the positive voltage applied to said stationary anode is higher or lower than the positive voltage applied to said traveling electroplated wire anode to optionally favorably enhance the plating of said traveling wire cathode or deplating of said traveling wire anode.

* * * * *